US007344209B1

(12) United States Patent
Miyashiro

(10) Patent No.: US 7,344,209 B1
(45) Date of Patent: Mar. 18, 2008

(54) ONE-WAY DRAWER STOP

(76) Inventor: Thomas H Miyashiro, 55 S. Judd St., No. 907, Honolulu, HI (US) 96817

( * ) Notice: Subject to any disclaimer, the term of this patent is extended or adjusted under 35 U.S.C. 154(b) by 0 days.

(21) Appl. No.: 11/042,659

(22) Filed: Jan. 25, 2005

(51) Int. Cl.
*A47B 88/00* (2006.01)

(52) U.S. Cl. ..... 312/333; 312/334.47

(58) Field of Classification Search ..... 312/333, 312/334.44, 334.45, 334.46, 334.47; 292/194, 292/195, 202, 209, 210, 300, 304, DIG. 63
See application file for complete search history.

(56) References Cited

U.S. PATENT DOCUMENTS

| | | | | |
|---|---|---|---|---|
| 2,699,567 | A | 1/1955 | Herscher | |
| 3,850,463 | A | 11/1974 | Hawkins | |
| 4,139,249 | A | 2/1979 | Hillman | |
| 4,416,477 | A | 11/1983 | Bialobrzeski et al. | |
| 4,423,914 | A | 1/1984 | Vander Ley | |
| 4,717,184 | A | 1/1988 | Boyce | |
| 5,203,620 | A | 4/1993 | McLennan | |
| 5,344,226 | A | 9/1994 | Lee | |
| 5,445,451 | A * | 8/1995 | Harmony | 312/333 |
| 5,542,759 | A | 8/1996 | Krivec | |
| 5,626,372 | A | 5/1997 | Vogt | |
| 5,769,517 | A | 6/1998 | Carde | |
| 5,823,649 | A | 10/1998 | Hinrichs | |
| 5,868,478 | A * | 2/1999 | Yemini | 312/333 |
| 6,250,730 | B1 * | 6/2001 | Roth et al. | 312/334.44 |
| 6,481,811 | B1 * | 11/2002 | Marsh | 312/333 |
| 6,997,527 | B2 * | 2/2006 | Cheng | 312/333 |
| 7,048,347 | B1 * | 5/2006 | Liu | 312/333 |

FOREIGN PATENT DOCUMENTS

| | | | |
|---|---|---|---|
| DE | 3347540 | * 7/1985 | 312/334.46 |
| DE | 2216780 | * 10/1989 | 312/333 |
| GB | 2.129.482 | 5/1984 | |
| GB | 2.182.546 | 5/1987 | |

* cited by examiner

*Primary Examiner*—Lanna Mai
*Assistant Examiner*—Hanh V. Tran
(74) *Attorney, Agent, or Firm*—Michael I. Kroll

(57) ABSTRACT

The present disclosure is a one-way drawer stop having a counterbalanced latch 16 and stop plate 20. In the preferred embodiment the latch mechanism 16 is installed on the sliding member 14 while the stop plate 20 is installed on the stationary member 22. In operation, the sliding member 14 is moved from a closed position where it encounters the stop plate 20 whereupon the exposed end of the latch mechanism 16 is depressed moving it from engagement with the stop plate allowing the sliding member to be fully opened. When the sliding member 14 is moved from the open position into the closed position, the latch 16 rides up and over the stop mechanism 20 providing the sliding member with a stop mechanism that prevents opening but not closing.

4 Claims, 10 Drawing Sheets

ONE-WAY DRAWER STOP

BACKGROUND OF THE INVENTION

1. Field of the Invention

The present invention relates generally to miscellaneous hardware and, more specifically, to a one-way drawer stop providing means for preventing small children from opening sliding door and drawers having the present invention installed thereon.

The present invention is comprised of a counterbalanced latch and stop plate. In the preferred embodiment the latch mechanism is installed on the sliding member while the stop plate is installed on the stationary member.

In operation, the sliding member is moved to an open position where it encounters the stop plate whereupon the exposed end of the latch mechanism is depressed moving it from engagement with the stop plate allowing the sliding member to be fully opened. When the sliding member is moved into the closed position, the latch rides up and over the stop mechanism providing the sliding member with a stop mechanism that prevents opening but not closing.

2. Description of the Prior Art

There are other lock devices designed for childproofing. Typical of these is U.S. Pat. No. 2,699,568 issued to Herscher on Jan. 18, 1955.

Another patent was issued to Hawkins on Nov. 26, 1974 as U.S. Pat. No. 3,850,463. Yet another U.S. Pat. No. 4,139,249 was issued to Hillman on Feb. 13, 1979 and still yet another was issued on Nov. 22, 1983 to Bialobrzeski, et al. as U.S. Pat. No. 4,416,477.

Another patent was issued to Vander Ley on Jan. 3, 1984 as U.S. Pat. No. 4,423,914. Yet another U.S. Pat. No. 4,717,184 was issued to Boyce on Jan. 5, 1988. Another was issued to McLennan on Apr. 20, 1993 as U.S. Pat. No. 5,203,620 and still yet another was issued on Sep. 6, 1994 to Lee as U.S. Pat. No. 5,344,226.

Another patent was issued to Krivec on Aug. 6, 1996 as U.S. Pat. No. 5,542,759. Yet another U.S. Pat. No. 5,626,372 was issued to Vogt on May 6, 1997. Another was issued to Hinrichs on Oct. 20, 1998 as U.S. Pat. No. 5,823,649 and still yet another was issued on Jun. 23, 1998 to Carde as U.S. Pat. No. 5,769,517. Another patent was issued to Meier, et al. on May 16, 1984 as U.K. Patent No. GB 2 129 482 and still yet another was issued on May 20, 1987 to Rock, et al. as U.K. Patent No. GB 2 182 546.

U.S. Pat. No. 2,699,568

Inventor: Marcus B. Herscher

Issued: Jan. 18, 1955

A safety device for restricting relative movement between a movable and stationary member wherein said movable member is mounted for slidable movement within said stationary member, said safety device comprising an elongated pawl pivotally mounted at one end about an axis and on said stationary member with the other end freely disposed, said pawl having a shoulder which overhangs and defines a latch recess, said recess extending from an edge nearest said movable member partly across said pawl, said shoulder extending from an edge nearest said movable member across said pawl and slanting toward said pivoted end, latch means pivotally mounted about an axis and on said movable member, said pawl axis and said latch axis being perpendicular with respect to each other, said latch means having—a hook-like portion, said hook-like portion being engageable with said latch recess on said pawl, and means for biasing said latch means about its axis toward engagement with said pawl, said latch means cooperating with said slantingly disposed shoulder on said pawl upon engagement therewith to maintain said pawl in a position to effect positive locking of said members.

U.S. Pat. No. 3,850,463

Inventor: Donald B. Hawkins

Issued: Nov. 26, 1974

A latch assembly for preventing unauthorized entry into a drawer or the like includes a latch arm with a longitudinally extending slot at one end, and a transversely extending slot disposed generally medially in the arm. Adjacent to one end of the transverse slot an angled latch lug extends transversely from the latch arm to selectively engage the top of a drawer hole during opening. A screw passing through each slot slidably secures the arm to the interior surface of the side of a drawer, and a spring biases the arm upwardly. Included in the transverse slot are upper and lower detents, the former selectively engaging the transverse slot screw to prevent the lug from engaging the top of the drawer opening. With the screw freely disposed in the transverse slot, the drawer may be closed. Upon opening of the drawer, the lug engages the edge of the drawer hole, forcing the lower detent to engage the transverse slot screw and preventing further entry into the drawer by children, pets and those unaware of the latch assembly. The drawer may be fully opened by manually disengaging the lower detent and depressing the latch arm.

U.S. Pat. No. 4,139,249

Inventor: Ernest C. Hillman

Issued: Feb. 13, 1979

A child-proof cabinet latch having a base mounted on an inaccessible inwardly facing surface of a closure panel and a restraining member that is slidable in a guide channel defined by the base. The restraining member is movable between a first position in which an abutment surface is engageable with the cabinet frame to permit only limited opening movement of the panel and a second position in which the abutment surface is not engageable with the frame to permit unlimited opening movement. A spring biases the restraining member toward its first position, the spring force being such that it can be overcome by an adult but not a small child.

U.S. Pat. No. 4,416,477

Inventor: Walter Bialobrzeski, et al.

Issued: Nov. 22, 1983

A child-proof latch for attachment to a closure panel of a drawer, cabinet or the like, the closure panel being moveable with respect to a frame or the like, the latch comprising: a support base for mounting on said closure panel; a pair of elongate restraining arms projecting outwardly with respect to said base in generally parallel relation to each other and being separated along their length by a space, each said restraining arm having an end portion including means for abutting said frame, said restraining arms, being biased toward said frame to provide for engagement of said frame by both said abutting said panel with respect to said frame to a predetermined distance, each said restraining arm being movable independently of the other restraining arm against said bias away from said frame to disengage said abutting means to permit further opening of said panel only upon simultaneous movement of both restraining arms; and a wall projecting from said base in said space between said restraining arms, said wall having a length sufficient to span the said predetermined distance between said panel and said frame, said wall including an upper surface located above said restraining arms, said wall for preventing single finger simultaneous movement of both said restraining arms by imposition of a downward force on said restraining arms.

U.S. Pat. No. 4,423,914

Inventor: Robert J. Vander Ley

Issued: Jan. 3, 1984

A drawer locking lever pivotally mounted between its ends to a drawer mounting strip, with a drawer rail locking element at one end of the lever and an integral deformable spring element at the other end for biasing said locking element toward a drawer rail, there being an actuator element at said other end of the lever for pivoting the lever against the bias of said spring element to release the locking element from the drawer rail.

U.S. Pat. No. 4,717,184

Inventor: Phil Boyce

Issued: Jan. 5, 1988

A child resistant safety latch for the door or drawer of an enclosure such as a cabinet. The door or drawer is latched in a slightly ajar position from which it can neither be fully opened nor reclosed, preventing both access to the contents of the enclosure and possible injury to the child's fingers upon reclosure.

U.S. Pat. No. 5,203,620

Inventor: Bruce H. McLennan

Issued: Apr. 20, 1993

A pivotal drawer guide latch is affixed to a central bottom cabinet drawer guide of a cabinet drawer to prevent inadvertent removal of the drawer from the cabinet. A spring maintains the latch in a normal downward position to allow the latch to catch the front cabinet rail as the drawer is opened. To remove the drawer from the cabinet, the latch is depressed thereby allowing the drawer to be totally removed from the cabinet. A biased face on the latch allows the catch to slide over the front rail as the drawer is reinserted into the cabinet.

U.S. Pat. No. 5,344,226

Inventor: Wen-Ting Lee

Issued: Sep. 6, 1994

A safety device includes a substantially L-shaped mount securely mounted to an inner wall of a side panel of a drawer and a sliding assembly. The mount includes a vertical portion on which a first track is provided and a horizontal portion in which a hole is formed. The sliding assembly includes a body having at least one compartment for optionally receiving a stop and a second track extending longitudinally from the body. A member projects from the body and is slidably received in the first track. A pin extends downward from the body and has a snapping head at a distal end thereof to prevent excessive upward movement of the pin. A spring is wound around the pin. The sliding assembly further has a slider slidably received in the second track. By such an arrangement, the drawer is limited, by the upper edge of the desk, between the stop and the slider.

U.S. Pat. No. 5,542,759

Inventor: Bert Krivec

Issued: Aug. 6, 1996

A disconnect latch is provided for use with a drawer slide assembly of the type including an elongated drawer member and a stopper for limiting longitudinal travel of the elongated drawer member. The disconnect latch includes the unitarily formed combination of a lever, a mounting section for non-pivotally coupling the disconnect latch to the elongated drawer member, and a main body portion integral with the lever at one end thereof and with the mounting section at the opposite end thereof. The main body portion includes a stop surface for maintaining the elongated drawer member in a locked condition. A plurality of longitudinally spaced grooves is further included, each spanning the whole vertical height of the main body portion. The grooves facilitate the non-pivotal flexing of the disconnect latch so as to allow the stop surface to clear the locking member when downward pressure is applied to the lever, as well as to allow shock absorption during impact of the stop surface against the stopper.

U.S. Pat. No. 5,626,372

Inventor: Peter A. Vogt

Issued: May 6, 1997

A mechanically operated latch includes a stop member and a restraining member which are disposable between an engageable position and a disengageable position. In which a restraining member is displaceable between a first position in which an abutment surface is engageable with the stop member which is attached to the cabinet frame to permit only limited opening movement of the panel and a second position in which the abutment surface is not engageable with the stop member to permit unlimited opening movement of the panel. The force required to activate the latch is such that it can be overcome by an adult but not by a small child.

U.S. Pat. No. 5,769,517

Inventor: Felix Carde

Issued: Jun. 23, 1998

A drawer safety lock includes a counterbalanced latch plate, pivotally moveable manually between an upwardly pivoted limit position and an unlocked position, normally counterbalanced toward the limit position, and a latch plate stop, positioned with respect to the latch plate for restricting movement of the latch plate beyond the upwardly pivoted limit position, so that the safety lock requires no resilient bending or flexible spring action for its operating movement.

U.S. Pat. No. 5,823,649

Inventor: Gary M. Hinrichs

Issued: Oct. 20, 1998

A child-proof drawer lock assembly for drawers fitted with or without drawer slide rollers. The lock assembly is movably mounted on the external drawer side of the drawer. A restraining member is mounted to a lever that is accessible when the drawer is partially opened. The restraining member alternatively engages a cabinet-mounted drawer slide roller through a slot in the drawer-mounted drawer slide or engages the interior of the cabinet face. The drawer is unlatched by lifting the pivotally mounted lever a sufficient distance so that the restraining member clears the roller, or the cabinet face, while the drawer is conventionally opened. The assembly can also be disengaged to allow for conventional operation of the drawer.

U.K. Patent Number GB 2 129 482

Inventor: Gerd Meyer, et al.

Issued: May 16, 1984

Securing lock for drawer cabinets wherein each drawer in a drawer cabinet is provided with a locking member for raising and locking the locking member. When a drawer is pulled out, lifting member is displaced thereby by means of a finger or cam which engages the lifting member. The lifting member in turn displaces the locking member are also raised by the connecting pieces and lock the drawers which have not been opened.

U.K. Patent Number GB 2 182 546

Inventor: Erich Rock, et al.

Issued: May 20, 1987

A drawer comprising double-walled drawer frames of plastics material, a front plate is fastened at both sides by means of holding members. Each holding member carries a locking member which engages at the drawer frame. The locking member can be an eccentric hook, a pivot lever or a threaded pin.

While these hardware devices may be suitable for the purposes for which they were designed, they would not be as suitable for the purposes of the present invention, as hereinafter described.

SUMMARY OF THE PRESENT INVENTION

The present invention discloses a counterbalanced latch and stop plate. In the preferred embodiment the latch mechanism is installed on the sliding member while the stop plate is installed on the stationary member. In operation, the sliding member is moved from a closed position where it encounters the stop plate whereupon the exposed end of the latch mechanism is depressed moving it from engagement with the stop plate allowing the sliding member to be fully opened. When the sliding member is moved from the open position to the closed position, the latch rides up and over the stop mechanism providing the sliding member with a stop mechanism that prevents opening but not closing.

A primary object of the present invention is to provide a one-way stop mechanism for slidably engaging members.

Another object of the present invention is to provide a one-way stop to prevent small children from gaining access to the contents of a drawer.

Yet another object of the present invention is to provide a one-way stop to prevent small children from opening a sliding door.

An additional object of the present invention is the prevention of inadvertent or unwanted opening of drawers or sliding doors due to centrifugal forces or attitudinal changes encountered in moving vehicles, water craft and airplanes.

Still yet another object of the present invention is to provide a one-way stop that functions as a stop only in the opening mode.

Another object of the present invention is to provide a one-way stop comprising a latch and stop plate.

Yet another object of the present invention is to provide a one-way stop wherein said latch mechanism is a counterbalanced lever.

Still yet another object of the present invention is to provide a one-way stop wherein the stop plate has an angular stop whereby the latch lever will engage and pass over in the closing mode.

Additional objects of the present invention will appear as the description proceeds.

The present invention overcomes the shortcomings of the prior art by providing a one-way drawer stop providing means for preventing small children from opening sliding doors and drawers having the stop installed thereon. The one-way stop has a latch mounted onto a sliding member so that when the sliding member is moved to an open position it encounters the stop plate whereupon the exposed end of the latch mechanism must be depressed moving it from engagement with the stop plate allowing the sliding member to be fully opened. When the sliding member is moved into the closed position, the latch rides up and over the stop mechanism providing the sliding member with a stop mechanism that prevents opening but not closing.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
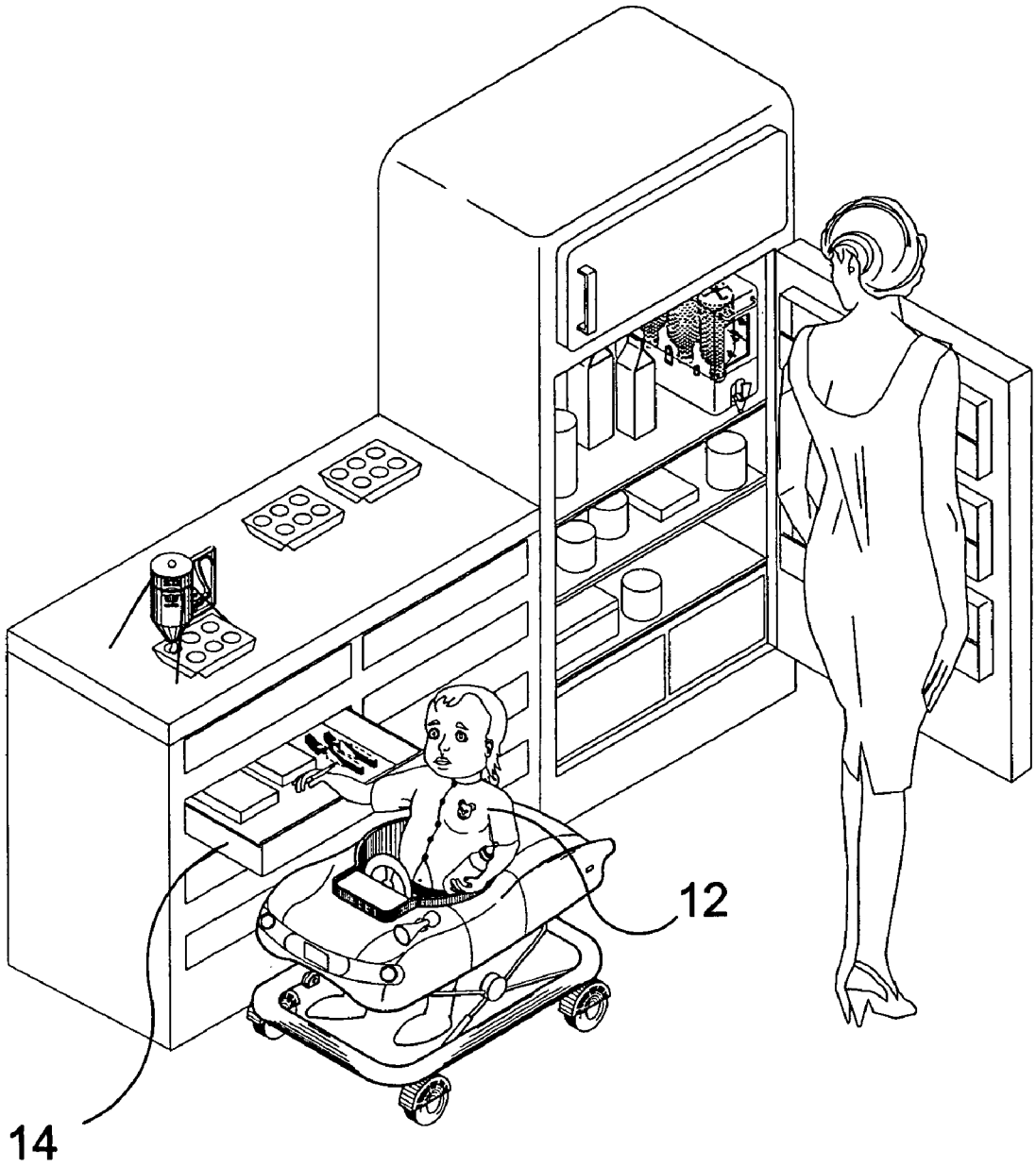
FIG. 1 (PRIOR ART)
FIG. 1 is an illustrative view of prior art.

With regard to reference numerals used, the following numbering is used throughout the drawings.

10 present invention
12 children
14 drawer
16 latch lever
18 latch lever plate
20 stop
22 cabinet
24 pivot
26 counter balance
28 finger
30 track mechanism
32 drawer front
34 edge of counter
36 cabinet face
38 arrow
40 flange

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the prior art. The present invention is a counter balanced safety sliding lock that prevents children 12 from opening drawers 14. The device can be installed on existing slide type drawers 14 and sliding doors and converts them into a latched drawer or door that can be opened only by opening the drawer or door until the latch stopping element is encountered and then depressing the exposed end of the counterbalanced latching mechanism. Once opened, the latch mechanism does not interfere with the full opening and removal of the drawer 14 and also does not interfere with the normal smooth closing of the drawer. The novel aspect of the device of the present invention is that it stops the drawer 14 or door in one direction and allows free movement in the other direction.

Figure 2:
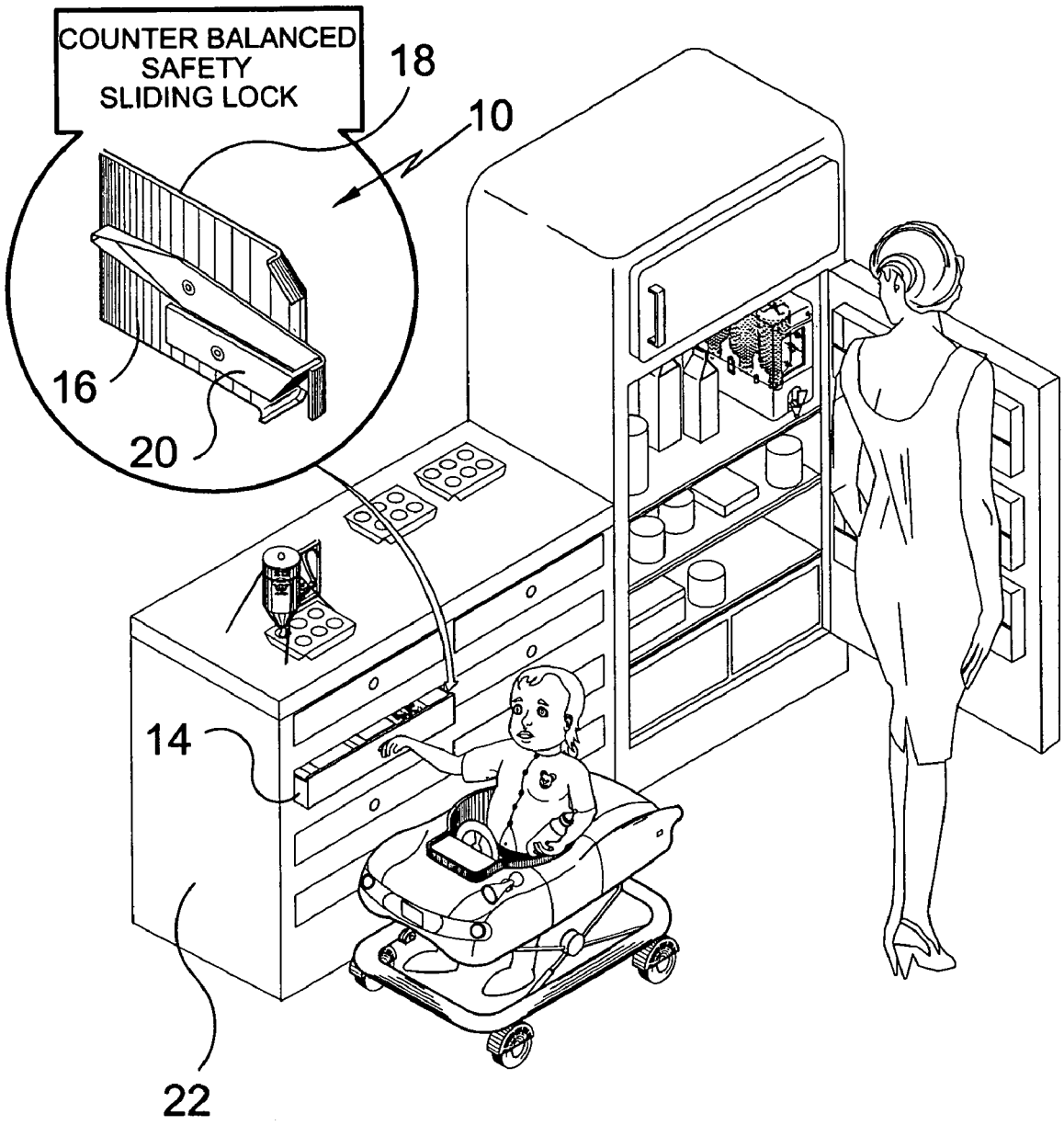
FIG. 2 is an illustrative view of the present invention.

Turning to FIG. 2, shown therein 2 is an illustrative view of the present invention 10. The present invention 10 is a counter balanced safety sliding lock comprising a simple design that involves only one moving part wherein the counterbalanced latch lever 16 is pivotally attached to a latch lever plate 18. The angle stop 20 is mounted to one of the stationary elements, e.g., a wall of a cabinet 22, while the latch lever plate 18 is mounted to the opposing sliding element, e.g., the drawer 14. This safety device 10 can be installed in existing drawer installations with no required modifications and it is inconspicuous to children and easily installed.

Figure 3:
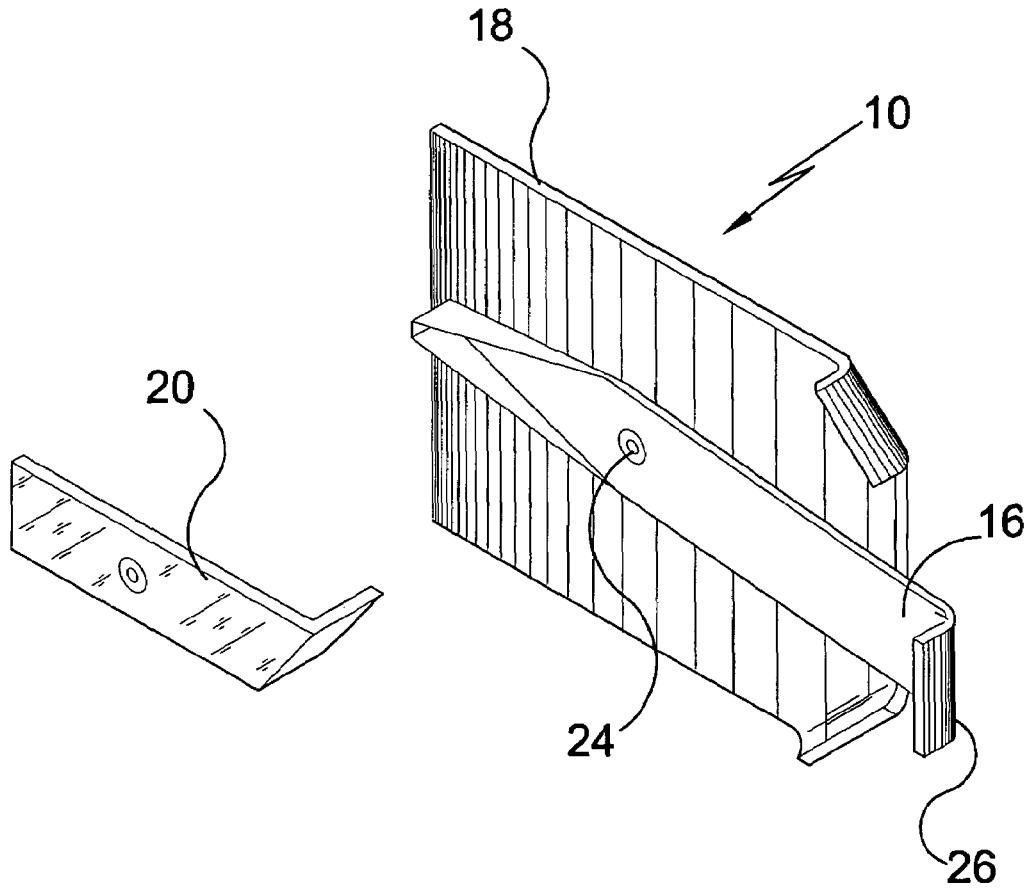
FIG. 3 is a perspective view of the present invention.

Turning to FIG. 3, shown therein is a perspective view of the present invention 10. Shown is the present invention 10 being a counter balanced safety sliding lock with angled stop 20 and latch lever 16 assembly in the closed position. The design involves only one moving part, the latch portion 16 which is pivotally attached at pivot 24 to a latch lever plate 18 and then mounted to the side wall of opposing sliding members, e.g., the drawer. Its counter part, the angle stop 20 is fixedly attached to the opposite stationary member. Counter balance 26 is also shown.

Figure 4:
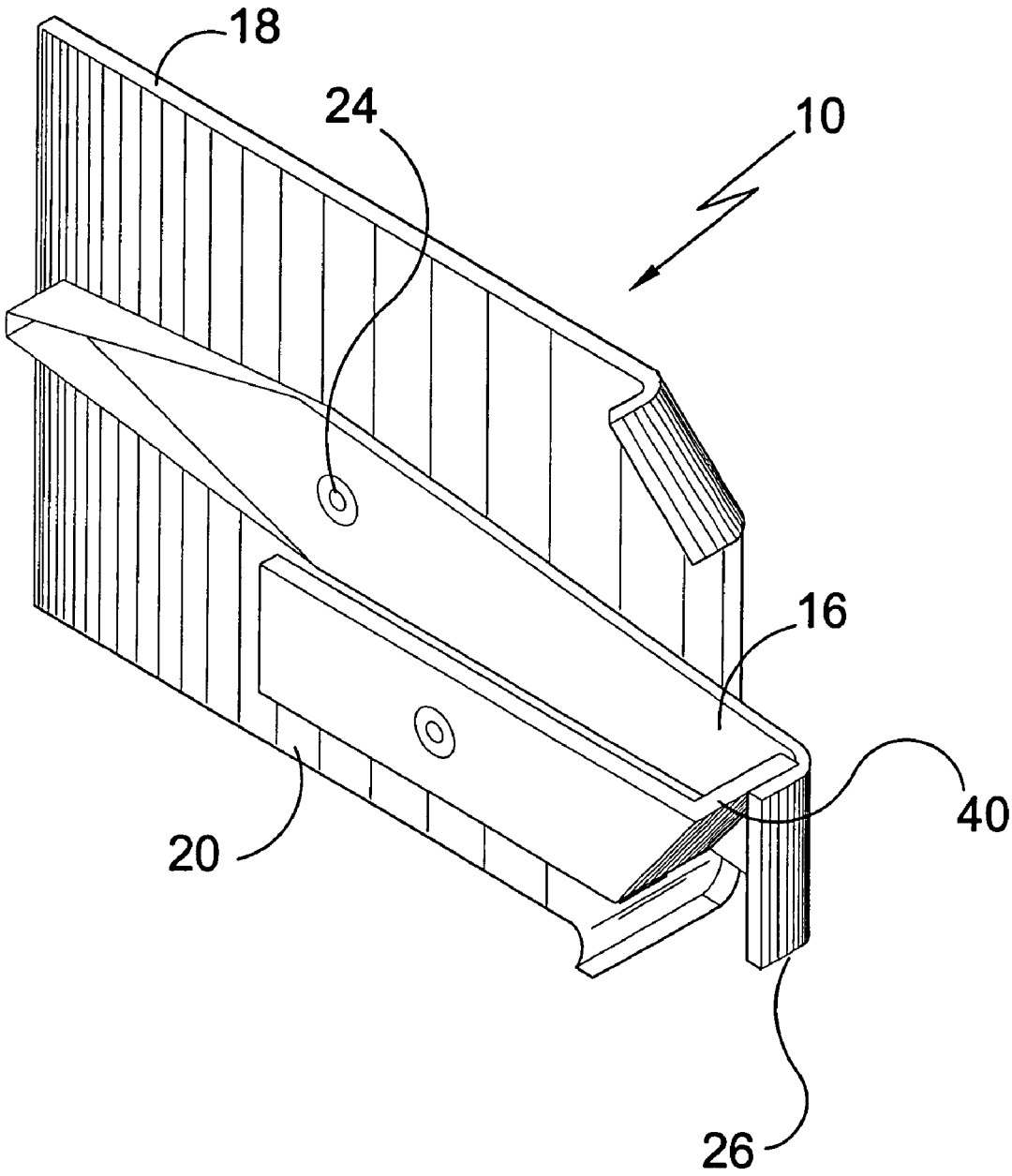
FIG. 4 is a perspective view of the present invention.

Turning to FIG. 4, shown therein is a perspective view of the present invention 10. Shown is the present invention 10 being a counter balanced safety sliding lock with angled stop 20 and latch lever 16 assembly in an engaged position which occurs when one sliding member is moved until the counterbalanced flange at 26 on latch lever 16 engages the flange 40 of the angle stop 20 which will prevent further movement of the member having the latch mechanism attached thereto. To continue opening the sliding member the exposed end of the counterbalanced 26 latch lever 16 is depressed which raises the distal end of the lever over the angled stop 20. Also shown are plate 18 and pivot point 24.

Figure 5:
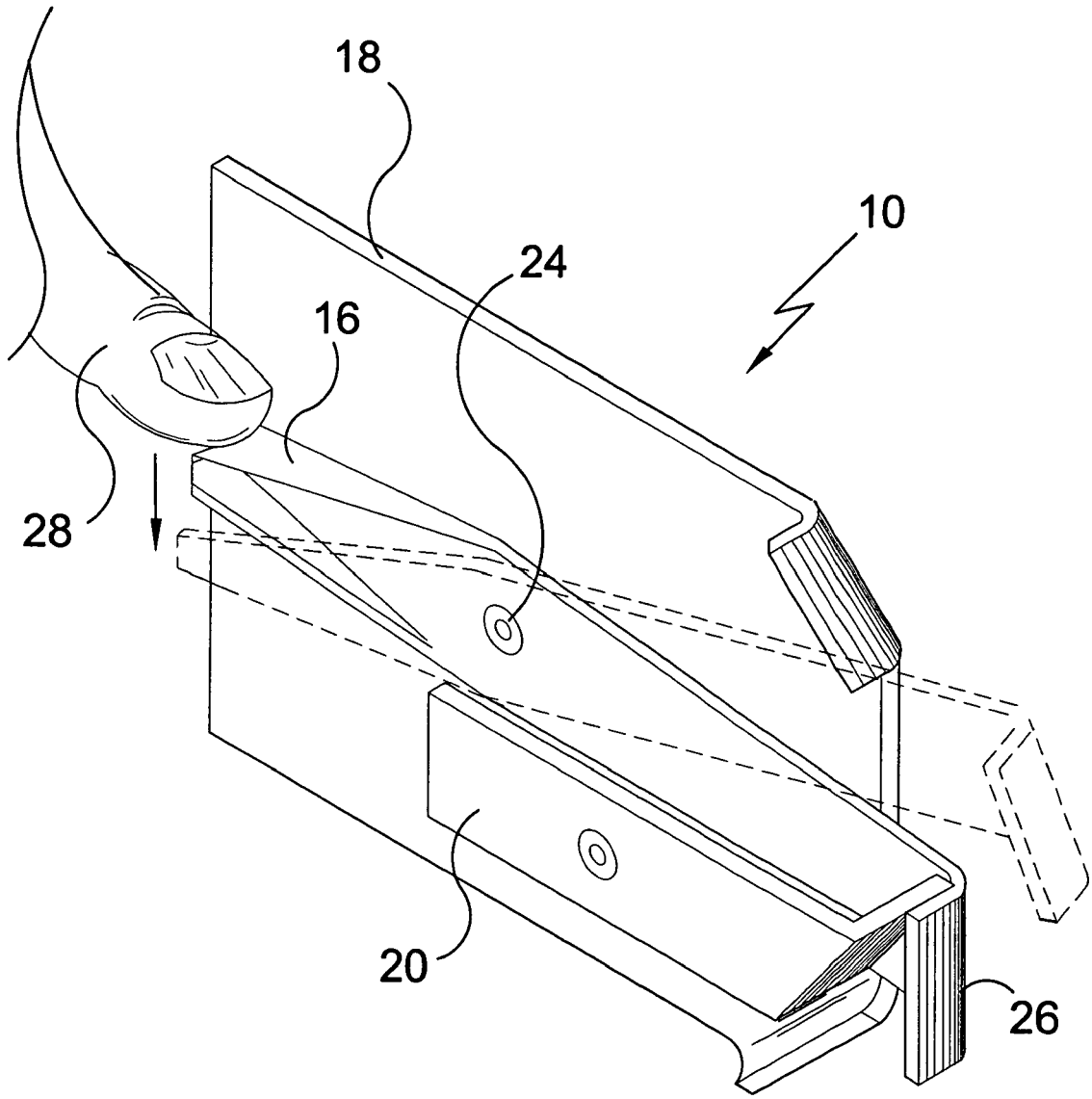
FIG. 5 is a perspective view of the present invention.

Turning to FIG. 5, shown therein is a perspective view of the present invention 10. Shown is the present invention 10 being a counter balanced 26 safety sliding lock with angled stop 20 and latch lever 16 assembly in an engaged and disengaged position with one sliding member moved until the latch lever and angled stop are engaged. Further movement is provided when the latch lever 16 is depressed by a user's finger 28 and released from the angle stop 20. The design involves only one moving part, the latch portion 16 which is pivotally attached at 24 to a latch lever plate 18 and mounted to one of an opposing sliding members while the angle stop 20 is mounted to the opposing stationary member, e.g., the stationary cabinet housing.

Figure 6:
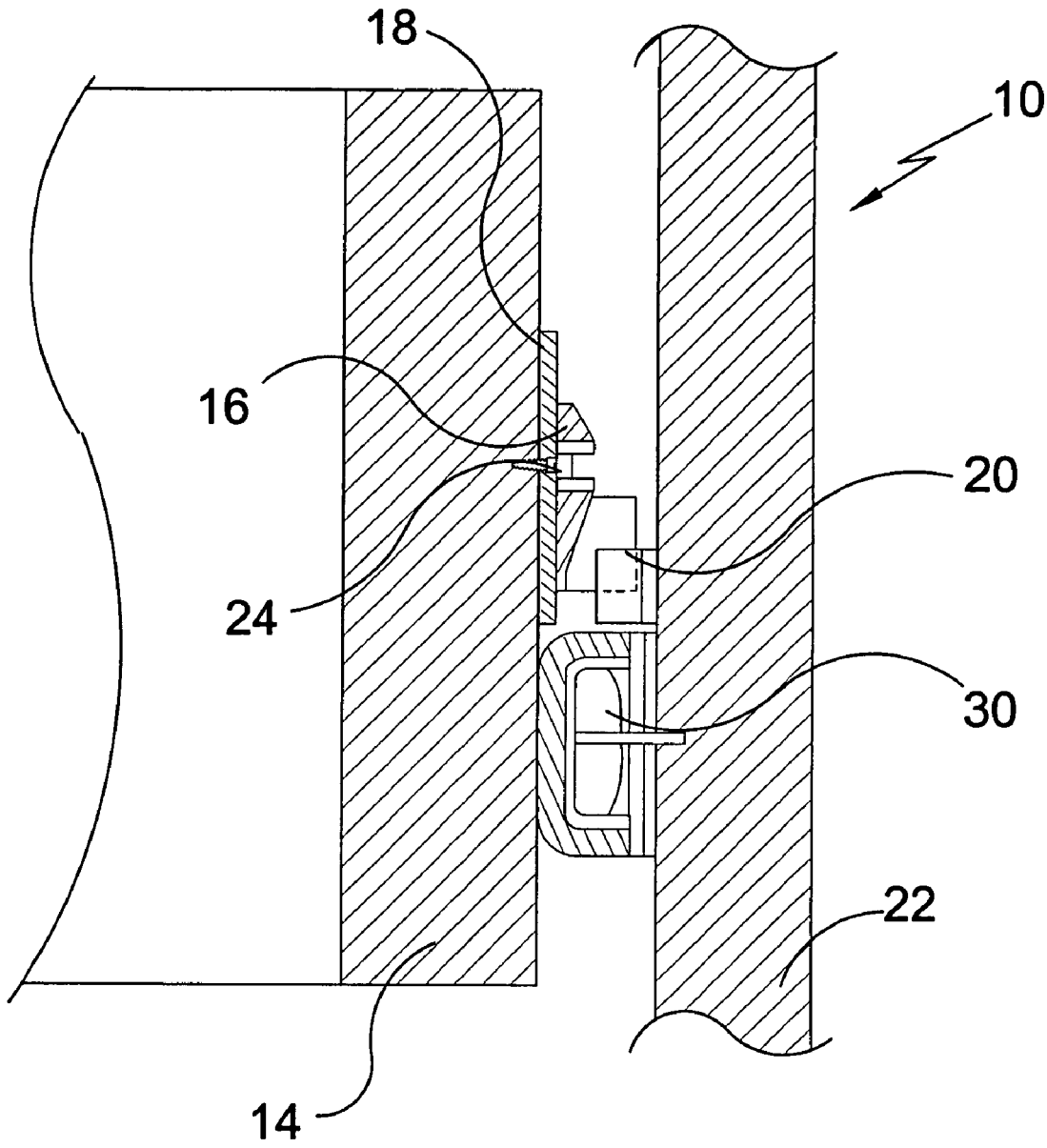
FIG. 6 is a sectional view of the present invention.

Turning to FIG. 6, shown therein is a sectional view of the present invention 10. Shown is a sectional view of the latching mechanism fixedly attached to opposing sliding members having the counterbalanced latch lever 16 and plate 18 mounted to one of the sliding members while the angle stop 20 is mounted to the opposing stationary member. The slidable members can be any opposing members which slide past each other as in a drawer 14 or door. Also shown are pivot 24, movable drawer 14, stationary cabinet wall 22 and a conventional slidable trade mechanism 30.

Figure 7:
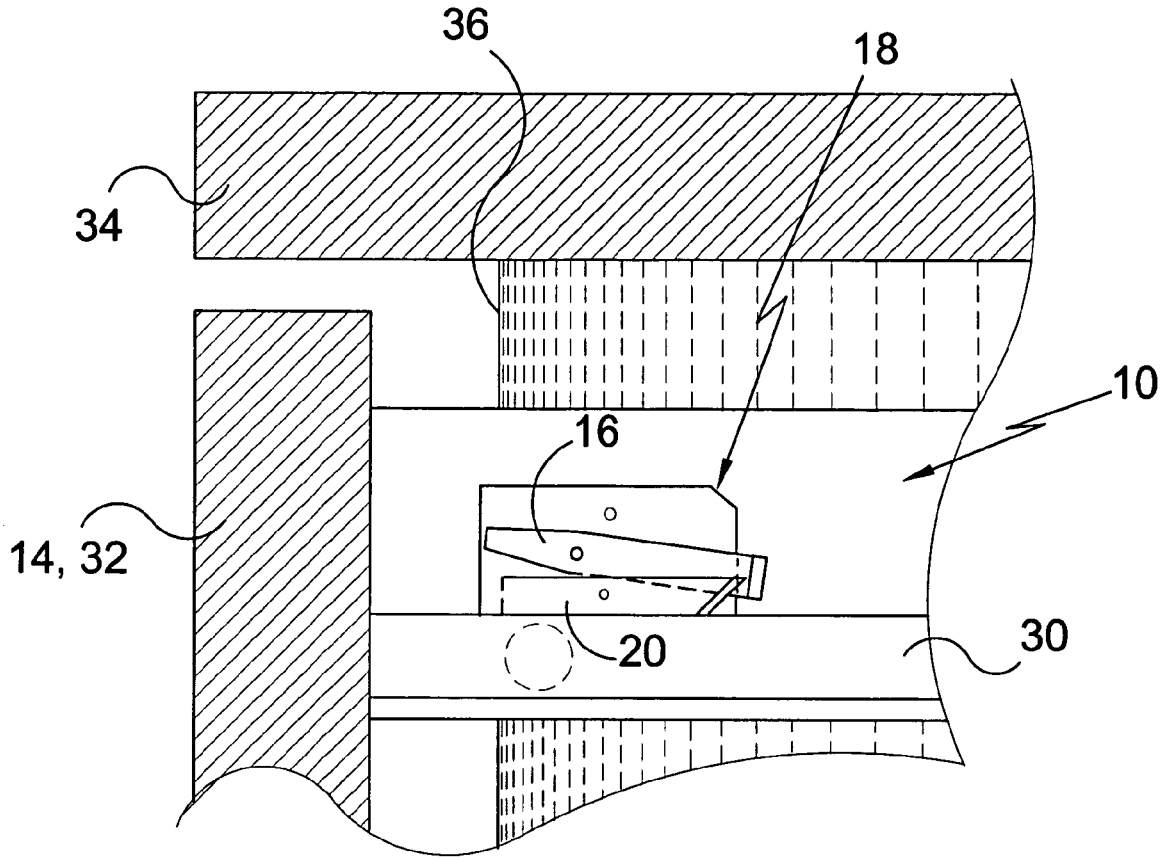
FIG. 7 is a side view of the present invention shown in a latched position.

Turning to FIG. 7, shown therein is a side view of the present invention shown 10 in a latched position. Shown is the present invention 10 being a counter balanced safety sliding lock with angled stop 20 and latch lever 16 assembly in an engaged position within a drawer 14 and slightly open. The drawer front 32 can not be opened any further unless the latch lever 16 is depressed and released from the angle stop 20. The design involves only one moving part, the latch portion 16 which is pivotally attached to a latch lever plate 18 and mounted to the side wall of a drawer 14. Its counter part, the angle stop 20 is fixedly attached to the opposing side. Also shown are the drawer slide or track 30, edge of counter 34, and cabinet face 36.

Figure 8:
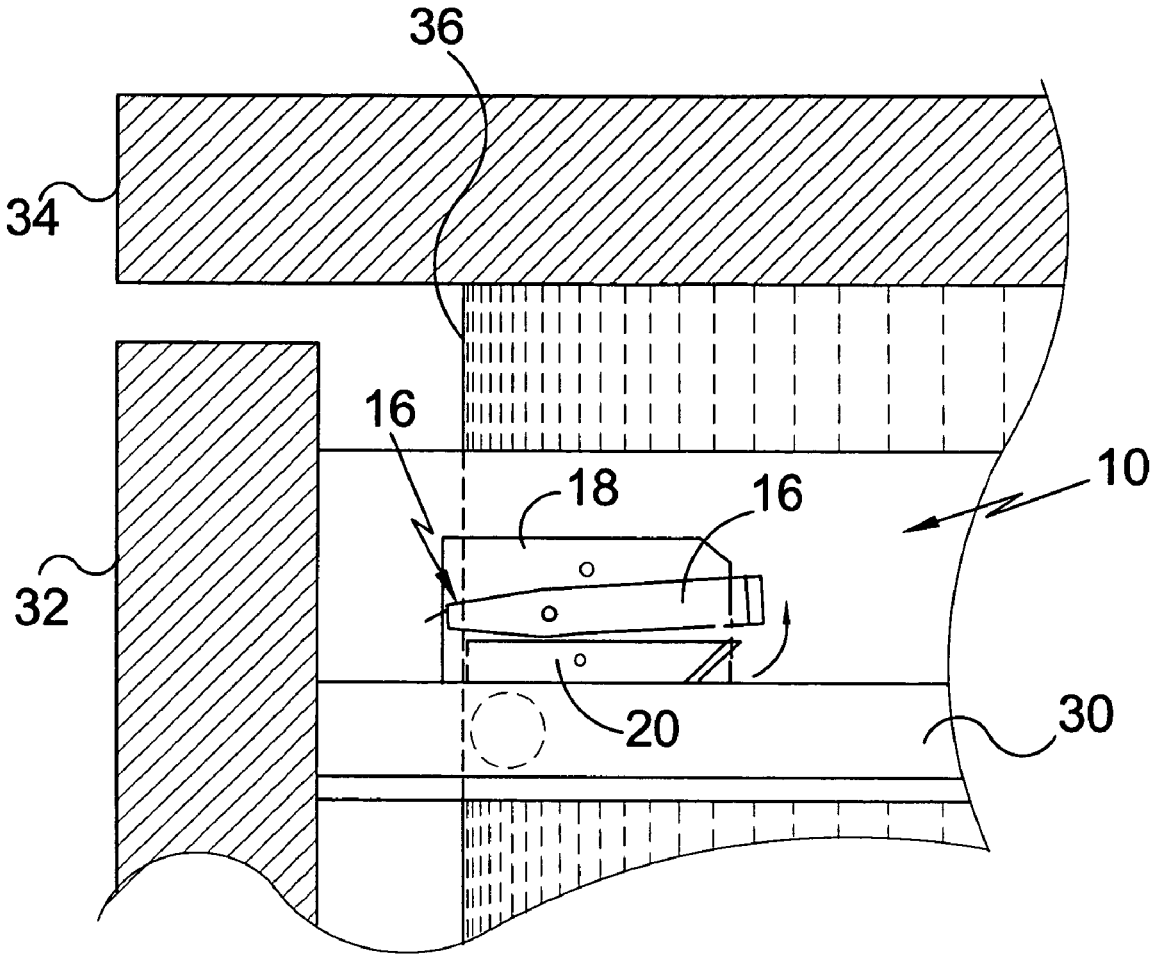
FIG. 8 is a side view of the present invention with lever raised to clear the angle stop.

Turning to FIG. 8, shown therein is a side view of the present invention 10 with lever 16 raised to clear the angle stop 20. Shown is the present invention 10 being a counter balanced safety sliding lock with angled stop 20 and latch lever 16 assembly in a disengaged position with drawer front 32 slightly opened providing means for depressing the latch lever which will move the distal end over the angle stop whereby the sliding member 32 can be moved to its open position. Also shown are track 30, counter edge 34, cabinet face 36, and plate 18.

Figure 9:
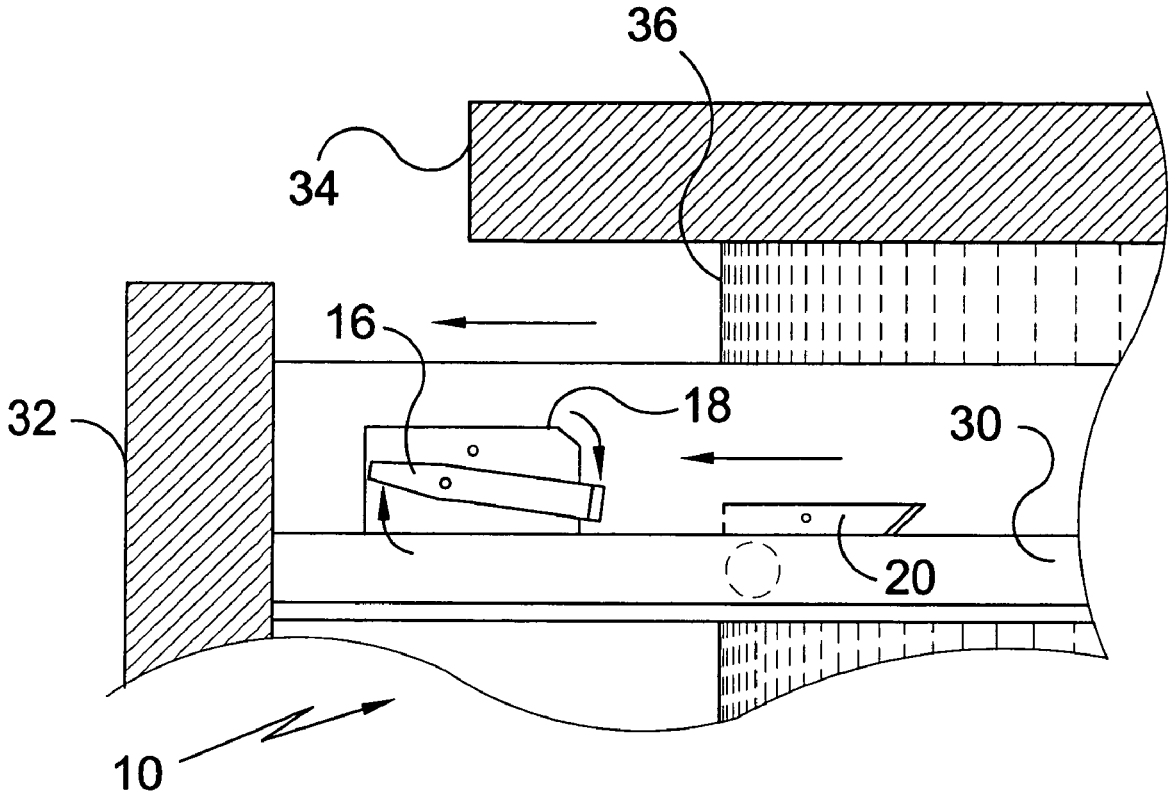
FIG. 9 is a side view of the present invention with lever released and returned to latched position.

Turning to FIG. 9, shown therein is a side view of the present invention 10 with lever 16 released and returned to latched position. Shown is the present invention 10 being a counter balance safety sliding lock with angled stop 20 and latch lever 16 assembly in an opened position with drawer front 32 fully opened and the latch lever positioned beyond the angle stop and latch lever returned to a down position. The design involves only one moving part, the latch portion 16 which is pivotally attached to a latch lever plate 18 and mounted to the side wall (right side) of a drawer. Its counter part, the angle stop 20 is fixedly attached to the stationary housing of the cabinet. Other previously disclosed elements are also shown.

Figure 10:
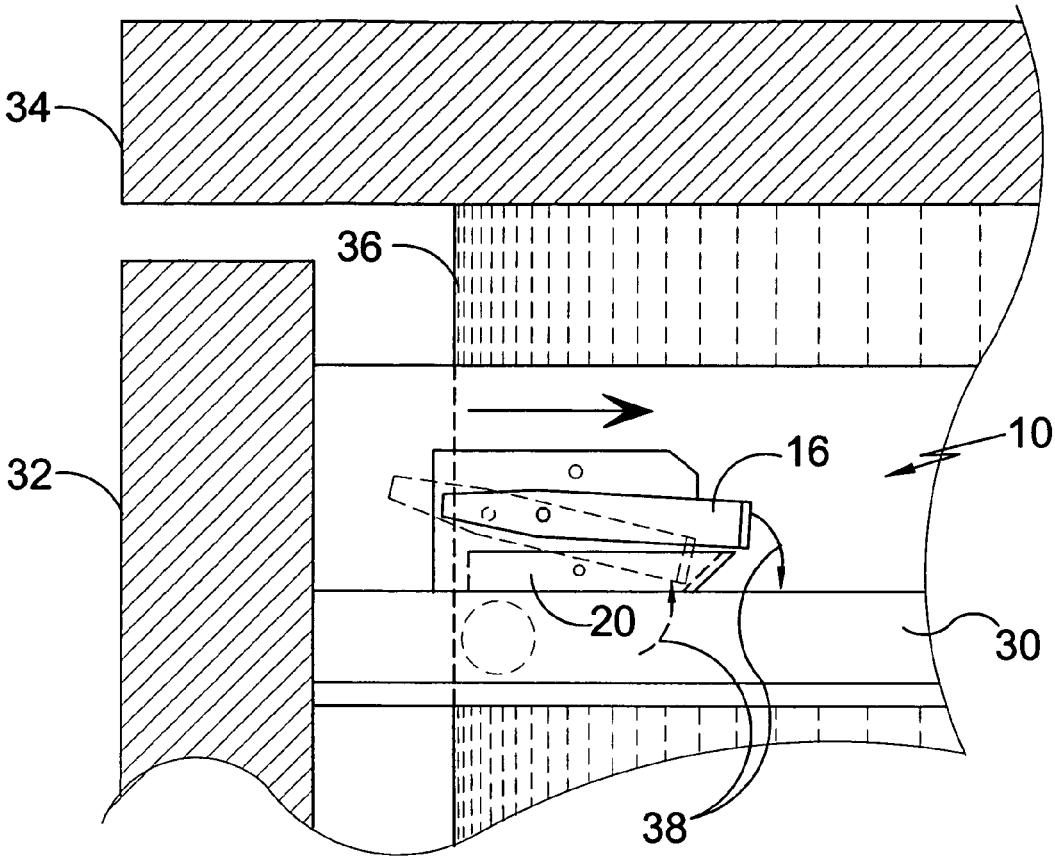
FIG. 10 is a side view of the present invention with the lever passing over the angle stop.

Turning to FIG. 10, shown therein is a side view of the present invention 10 with the lever 16 passing over the angle stop 20 with the closure movement being shown by arrow 38. The angular displacement of the angle stop 20 which slopes away from the front of the drawer 32 provides little to no resistance during closing causing the pivotal lever member 16 to ride up and over the angle stop. Other previously disclosed elements are also shown.

What is claimed to be new and desired to be protected by Letters Patent is set forth in the appended claims.

I claim:

1. A one-way drawer latch system comprising:

a) a latch assembly mounted between an outer side of a wall of a drawer and a wall of a cabinet, the drawer being slidable and inwardly and outwardly on a track mechanism mounted between the drawer and the cabinet, the drawer and the cabinet having a front and rear end; said latch assembly comprising:

b) a flat latch lever plate generally rectangular in configuration attached to the outer side of the wall of the drawer, the plate having inner and outer faces, wherein said inner face is contiguous to the wall of the drawer, said flat latch lever plate having top and bottom corners closest to the rear end of said drawer turned outwardly from said drawer;

c) a first pivot being disposed on said outer face of said latch lever plate;

d) a counterbalanced straight latch lever having first and second opposing ends and a second pivot connected to said first pivot, wherein said second pivot is disposed between said first and second ends and closer to said first end than said second end so that said second end is biased downwardly due to the force of gravity, said second end having a first flange thereon wherein said first flange extends away from said latch lever plate;

d) an angle stop attached to the wall of the cabinet proximate to said latch lever when the drawer is positioned inwardly in the cabinet, said angle stop having a second flange thereon wherein said second flange extends toward and engages said first flange when the drawer is pulled outwardly preventing said drawer from being pulled out further than a distance allowing a user to have access to the first end of said latch lever; and e) wherein said second end of said latch lever is movable from a first downward position to a second upward position in response to a user pressing downward on said first end of said latch lever, wherein said first flange of said second end is elevated above said second flange of said angle stop when said second end of said latch lever is in said second upward position to permit the drawer to be moved outwardly from the cabinet, wherein said second flange has a sloped surface facing the front of said drawer engaging said first flange forcing said second end of said opposing end of said latch lever to ride over said second flange when said drawer is pushed inwardly to permit the drawer to be locked inwardly in the cabinet, the first and second opposing ends of said latch lever being movable between said turned outwardly top and bottom corners of said flat latch lever plate, and, wherein said latch lever is the only moving part in said latch assembly.

2. The apparatus of claim 1, wherein said second flange has a first lower end and a second upper end, wherein said second flange is angled upwardly from said first lower end to said second upper end forming said sloped surface, and wherein said second upper end of said flange is angled away from the front of the drawer to permit the first flange to slide up and over the upper end of the second flange as the drawer is moved inwardly in the cabinet.

3. The apparatus of claim 2, wherein said first end of said latch lever has a smooth surface thereon for being pressed by a finger of a user.

4. The apparatus of claim 3, wherein said second flange is adjustable to permit the second flange to be adjusted upwardly and downwardly to make contact with said first flange.

* * * * *